United States Patent [19]

Grammer et al.

[11] Patent Number: 4,850,154

[45] Date of Patent: Jul. 25, 1989

[54] DEVICE FOR RELEASABLE MOUNTING OF A DISK-SHAPED TOOL

[75] Inventors: Werner Grammer; Manfred Kirn, both of Stuttgart, Fed. Rep. of Germany

[73] Assignee: Robert Bosch GmbH, Stuttgart, Fed. Rep. of Germany

[21] Appl. No.: 936,707

[22] Filed: Dec. 1, 1986

[30] Foreign Application Priority Data

Feb. 5, 1986 [DE] Fed. Rep. of Germany ..... 3603384

[51] Int. Cl.[4] ..... B24B 41/00

[52] U.S. Cl. ..... 51/209 R; 51/168

[58] Field of Search ..... 51/209 R, 168, 204, 51/206 R, 207 DL, 209 S; 269/315, 316, 317, 303; 279/2 R

[56] References Cited

U.S. PATENT DOCUMENTS 2,290,215 7/1942 Stenberg .
2,594,402 4/1952 Crawford .
4,322,190 3/1982 Anderson ..... 279/2 R
4,350,463 9/1982 Friedline .
4,525,097 6/1985 Ziegelmeyer .

FOREIGN PATENT DOCUMENTS 170604 2/1986 European Pat. Off. .
1204711 11/1970 United Kingdom .

*Primary Examiner*—Frederick R. Schmidt
*Assistant Examiner*—Maurina Rachuba

[57] ABSTRACT

A device for releasable mounting of a disk-shaped tool on a working spindle, comprises two flange members arranged to abut against the tool, supporting elements arranged to support one of the flange members against its axial displacement on the working spindle, wherein the supporting elements are releasable so as to unload the one flange member from a clamping pressure and formed as rolling bodies, arranged between the working spindle and the one flange member and displaceable transversely to their supporting direction into a deviating space.

11 Claims, 9 Drawing Sheets

Fig.10
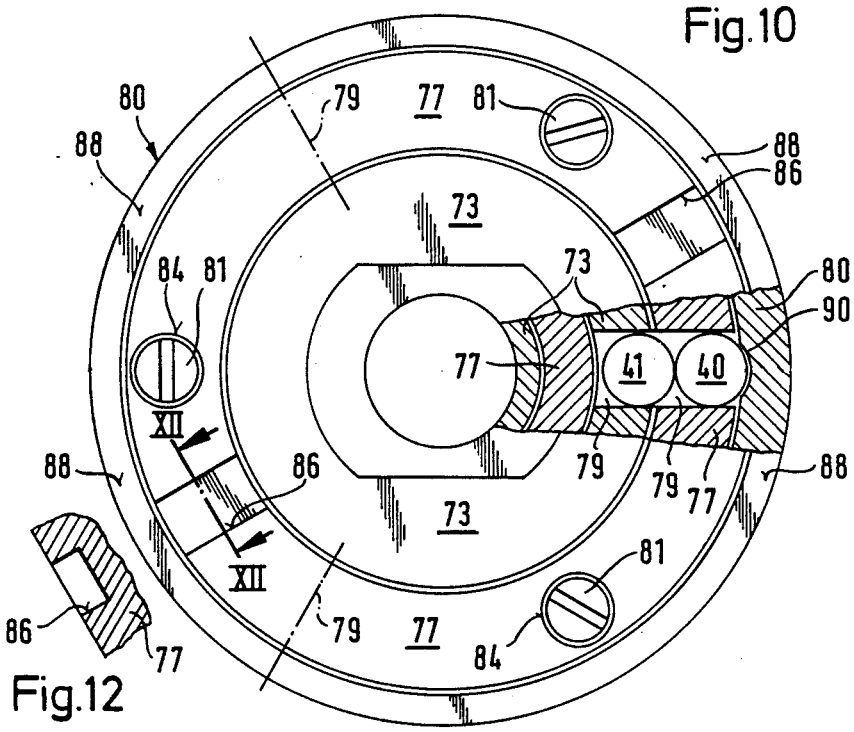
Fig.12
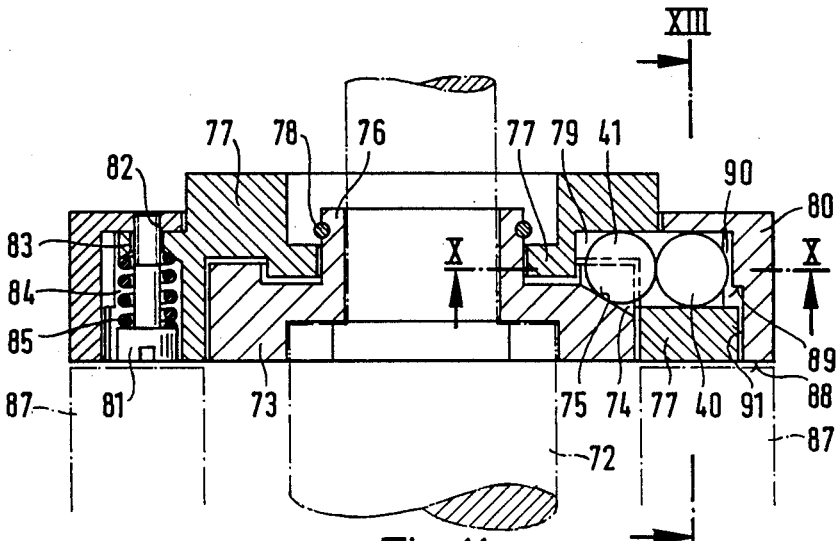
Fig. 11
Fig.13
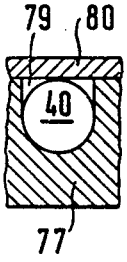

FIG. 19
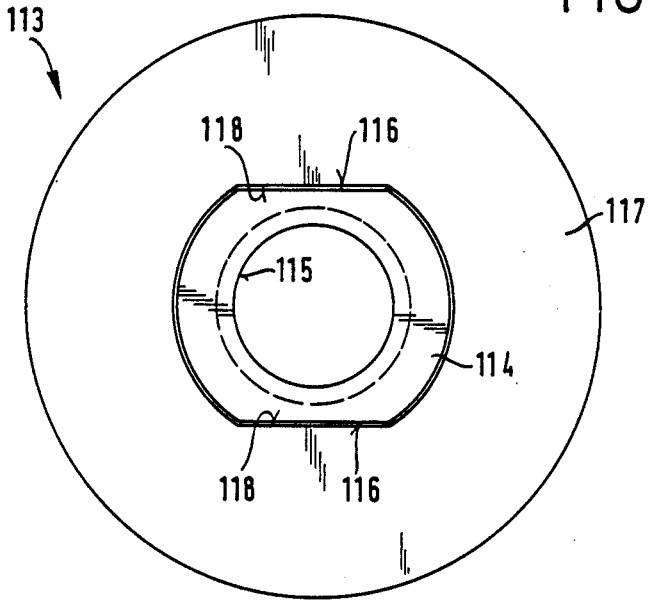
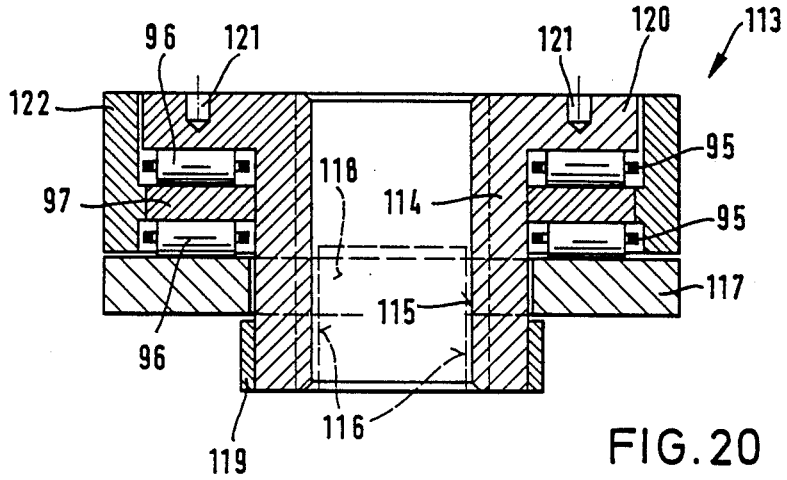
FIG. 20

DEVICE FOR RELEASABLE MOUNTING OF A DISK-SHAPED TOOL

BACKGROUND OF THE INVENTION

The present invention relates to a device for releasable mounting of a disk-shaped tool.

Devices of the above mentioned general type are known in the art. One of such devices is disclosed, for example, in the German document DE-OS No. 2,937,045. In this device the supporting member used for supporting the disk-shaped tool is problematic in its use. In the above described device the supporting member is a deformable medium which is arranged between two neighboring and axially movable parts, of which one part is associated with the clamping flange. More particularly, the deformable medium is located in a hollow space formed between these parts. During clamping of the disk-shaped tool, this medium is compressed to the limit of its compressibility. For facilitating releasing of the tool, at least one further wall portion of the above mentioned hollow space is displaceable to a position increasing the hollow space against a return force which is not surpassable by the reaction force of the compressed. The medium then can unload, whereby the clamping pressure is considerably reduced. When the medium is a rubber-elastic body, a considerable friction takes place for increasing the hollow space at the movable wall portion, and this friction must be overcome during the unloading. Moreover, this rubber-elastic body is subjected at this location to a high wear, since the wrapping surfaces are always subjected to abrasion. When the medium is viscous, there are sealing problems since leakage losses make the device inoperative very fast. For quiet hand tool operation, particularly for cutting on construction sites, this solution cannot be used at all.

SUMMARY OF THE INVENTION

Accordingly, it is an object of the present invention to provide a device for releasable mounting of disk-shaped tools, which avoids the disadvantages of the prior art.

More particularly, it is an object of the present invention to provide a device for releasable mounting of disk-shaped tools which is easily accessible and is characterized by low wear.

In keeping with these objects and with others which will become apparent hereinafter, one feature of the present invention, briefly stated, in a device of the above mentioned type in which supporting means is formed by a plurality of rolling bodies arranged in a space between a working spindle or an intermediate member axially nondisplaceably connected with the working spindle, and the rolling bodies are movable transversely to their supporting direction into a deviating chamber.

With the use of rolling bodies as a supporting means, very firm steel parts can be used for the inventive device. The path for releasing the clamping pressure for the disk-shaped tool is substantially smaller, and therefore the clamping flange can be completely unloaded. The exchange of the disk-shaped tools can be performed without additional hand tools.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 10 is a view showing a further embodiment of the invention, partially sectioned along the line X—X in FIG. 11;

FIG. 11 is a plane view of FIG. 10 in section;

FIG. 12 is a view showing a section taken along the line XII—XII in FIG. 10;

FIG. 13 is a view showing a section taken along the line XIII—XIII in FIG. 11;

FIG. 19 is a view of a further embodiment of the device with a clamping nut and rollers; and FIG. 20 is a side view of the device shown in FIG. 19, in section.

DESCRIPTION OF PREFERRED EMBODIMENTS

Figure 1:
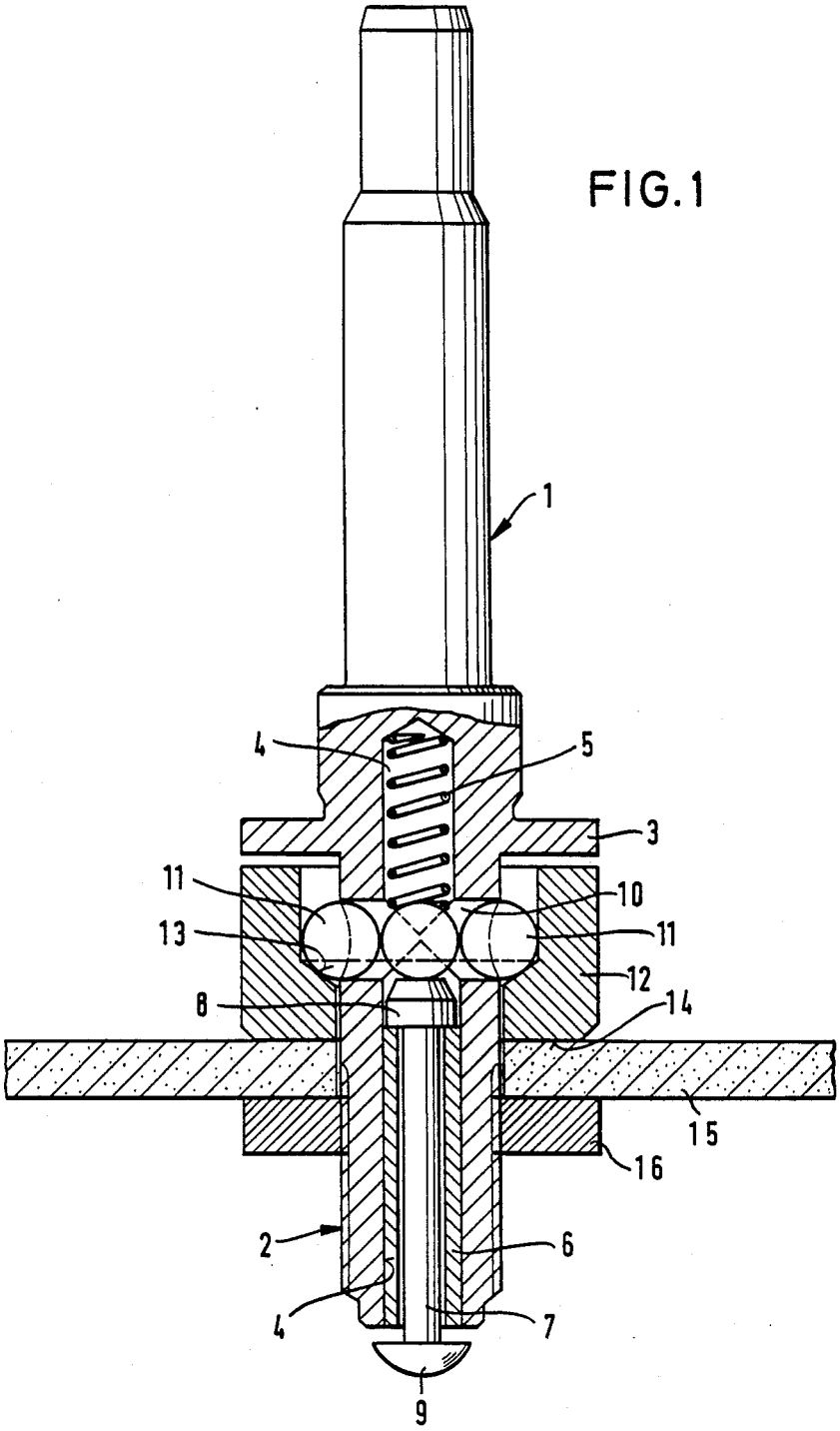
FIG. 1 is a view showing a device for releasable mounting of disk-shaped tools in accordance with one embodiment of the invention with a working spindle of a hand-operated power tool, partially in section.

In the device in accordance with the embodiment shown in FIG. 1, a working spindle 1 is provided with a threaded pin 2 and a collar 3. The working spindle 1 has a central, axially extending opening 4 which accommodates a helical spring 5. A bush 6 together with a pin 7 is pressed in the front part of the opening 4. The pin is provided with a head 8 inside the opening 4 and with an actuating handle 9 outside the opening. A transverse opening 10 in the threaded pin 2 intersects the opening 4. The transverse opening 10 serves as a guide for three balls 11. The central ball 11 is pressed by the helical spring 5 against the head 8 of the pin 7. It is therefore in alignment both with the opening 4 and with the transverse opening 10. The other two balls lie at opposite side of the central ball in the transverse opening 10. They extend outwardly beyond the outer surface of the threaded pin 2 with approximately one half of their diameter. A cup-shaped clamping flange 12 surrounds at this point the threaded pin 2 and holds the balls 11 in the transverse opening 10. A conical surface 13 in the clamping flange 12 abuts against the balls 11. The clamping flange 12 is thereby supported axially and provides with its end surface 14 a firm abutment for grinding disk 15. A clamping nut 16 which is screwed on the threaded pin 2 and serves for clamping the grinding disk 15.

As long as the threaded pin 2 carries a right-hand thread, it is sufficient to tighten the clamping nut 16 by hand. The clamping itself is performed then during grinding with the right-side rotation of the grinding disk 15. For releasing the clamping pressure for exchange of the grinding disk 15, the operator presses the pint 7 inwardly. Thereby the central ball 11 is pressed a little into the chamber provided inside the helical spring 5. The outer balls 11 under the action of the pressure of the clamping flange 12 which acts through the conical surface 17, deviate to the center of the working spindle. As a result of this, the clamping nut 16 is released so that the operator can unscrew it by hand.

Figure 2:
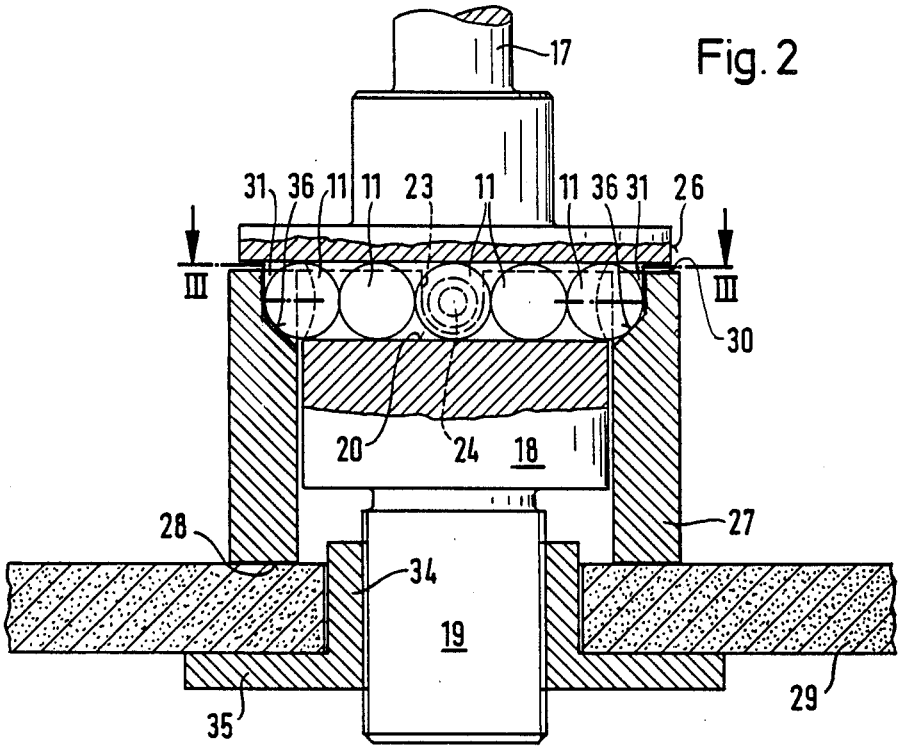
FIG. 2 is a view showing the inventive device in accordance with the second embodiment of the invention, at the end of a working tool, in section.
Figure 3:
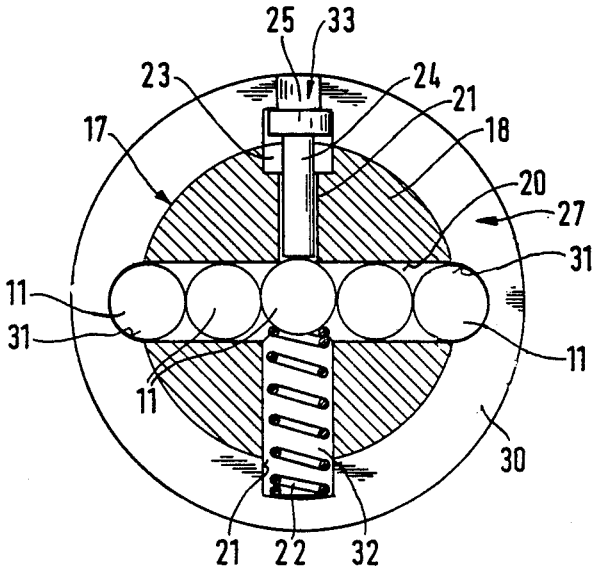
FIG. 3 is a view showing a section taken along the line III—III in FIG. 2.
Figure 4:
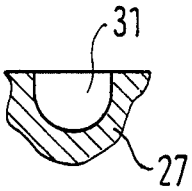
FIG. 4 is a view showing a section taken along the line IV—IV in FIG. 3.
Figure 5:
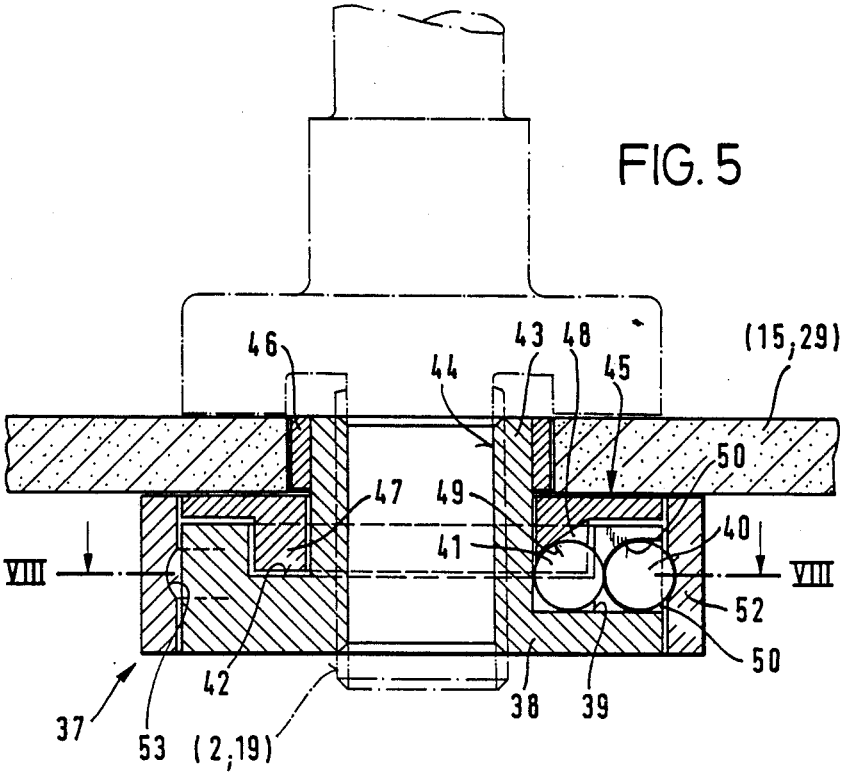
FIG. 5 is a view showing a longitudinal section of the device in accordance with a further embodiment of the invention, with a multi-part clamping nut.
Figure 7:
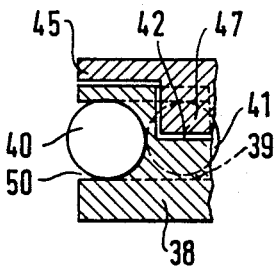
FIG. 7 is a view showing a section taken along the line VII—VII in FIG. 6.
Figure 6:
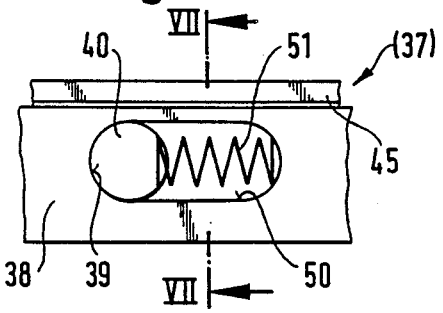
FIG. 6 is a view showing a section taken along the line VI—VI in FIG. 5.
Figure 8:
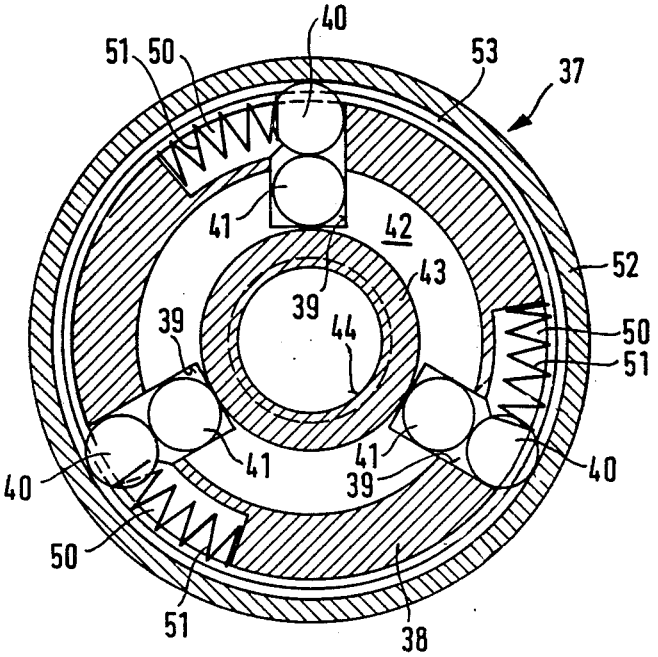
FIG. 8 is a view showing a section taken along the line VIII—VIII in FIG. 5.

The embodiment shown in FIGS. 2–4 is a device which operates on the same principle as the embodiment of FIG. 1. A working spindle 17 has a head 18 and a threaded pin 19 on the latter. The head 18 has two transverse throughgoing openings 20, 21 which intersect one another. The opening 20 has a constant diameter and accomadate five balls 11. The central ball 11 lies directly on the axis of the working spindle 17. The opening 21 has a stepped diameter. One part of the opening 21 accommodates a helical spring 22 and serves as a deviating chamber for the central ball 11. The other part of the opening 21 has a smaller diameter with an outer depression 23. A pin 24 is inserted in the depression 23 and has an end surface abutting the central ball 11. The central ball 11 can deviate from the opening 20 into the opening 21 so that it is no longer completely in alignment with the other balls 11 in the opening 20. This provides a security against unauthorized release during vibrations. A head 25 of the pin 24 has such a size that it can move into the depression 23. The head 18 has a collar 26 which directly follows the openings 20 and 21. The clamping sleeve 27 surrounds the head 18 before the collar 26. Its ring-shaped end surface abuts against a grinding disk 29 to be clamped. Its other ring-shaped end surface 30 is provided with two ball pockets 31, a spring pocket 32 and a stepped pocket 33. The greater part of the pocket 33 serves for receiving the head 25, the smaller part serves for the passage of the pin 24 for actuating the same from outside. A clamping nut 34 is screwed on the threaded pin 19 and clamps with its flange 35 the grinding disk 29 against the clamping sleeve 27. The ball pockets 31 have inclined supporting surfaces 36.

In the normal position the balls 11 are arranged in a row inside the opening 20. The outer balls 11 abut against the inclined supporting surfaces 36 in the ball pockets 21. They are supported by the remaining balls 11. The outer balls 11 press the clamping sleeve 27 against the clamping pressure of the flange 35 of the clamping nut 34. For clamping the grinding disk 29 it is sufficient to screw and tighten the clamping nut 34 by hand. The tightening is performed before the beginning of the grinding process. When the grinding disk 29 has to be exchanged, the operator presses the central ball 11 by means of the pin 24 against the action of the helical spring 22, out of the opening 20 into the opening 21. Thereby the outer balls 11 can deviate into the opening 20, and the clamping pressure of the clamping sleeve 27 is released. After this the clamping nut 34 can be easily released by hand. No additional tools are needed for exchanging the grinding disk.

In the embodiment shown in FIGS. 5–8, a clamping nut 37 in accordance with the present invention is shown and described. It main body 38 is provided with three radial openings 39. These openings are formed for receiving a pair of balls including an outer ball 40 and inner ball 41. The inner part of the radial openings 39 is half opening through an axially extending, ring-shaped recess 42 in the flange part of the main body 38. The recess 42 is directly connected with a hub part 43 of the main body 38. An axial opening of the main body 38 has a nut thread 44. The hub part 43 carries a clamping flange 45 which is secured by a ring 46 on the hub part 43 with an axial play. The ring 46 is firmly pressed against the hub part 43. The clamping flange 45 has a hub 47 with three pockets 48 having inclined surfaces 49. These pockets coincide in their position with the radial openings 39, so that the inner balls 41 can abut against the inclined surfaces 49 in the pockets 48. Pockets 50 are provided on the outer part of the radial openings 39 and extend over the periphery of the main body 38 from the radial openings 39. They are made in releasing direction of the clamping nut 37. The pockets 50 can receive the outer balls 40. Springs 51 line in them and retain the outer balls 40 always in their respective radial openings 39. A ring 52 surrounds both the main body 38 and the clamping flange 45 and is provided with a spherical trough 53. The ring 52 with the spherical trough 53 serve for guiding the outer balls 40 which simultaneously axially secure the ring 52.

The clamping is performed here in the manner which was described hereinabove with respect to the previous embodiment, however relative to a normal clamping flange of the working spindle 1 or 17. The clamping flange 45 of the clamping nut 37 is supported by the inner balls 41 on its inclined surfaces 49. The outer balls 40 support the inner balls 41 and support therefore on the ring 52. For releasing the clamping connection the ring 52 is turned into releasing position. The balls 40 are rolled inwardly against the action of the spring 51 into the pockets and release the inner balls 41. Therefore, the support for the clamping flange 45 disappears and it is released from the clamping pressure. The clamping nut 37 can be easily unscrewed by hand from the working spindle. At the end the balls 40 and 41 assume their clamping position under the action of the spring 51.

Figure 9:
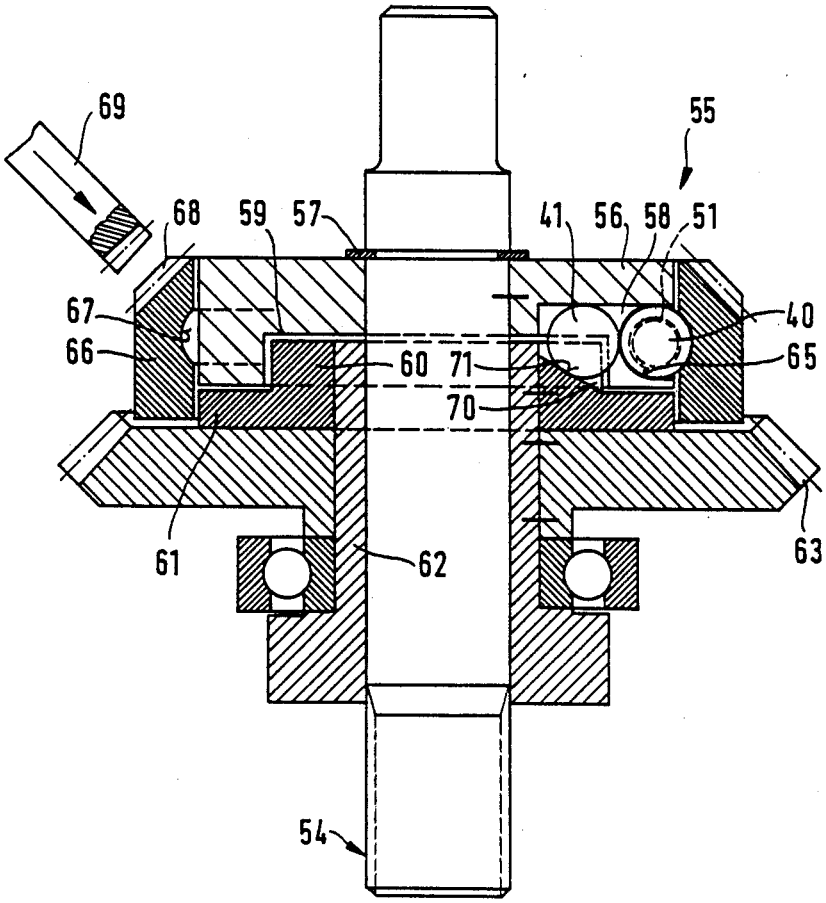
FIG. 9 is a view showing a section of the inventive device in accordance with still a further embodiment of the invention, with a clamping flange, a driving wheel 42, and a machineside lock for releasing the disk-shaped tool.
Figure 14:
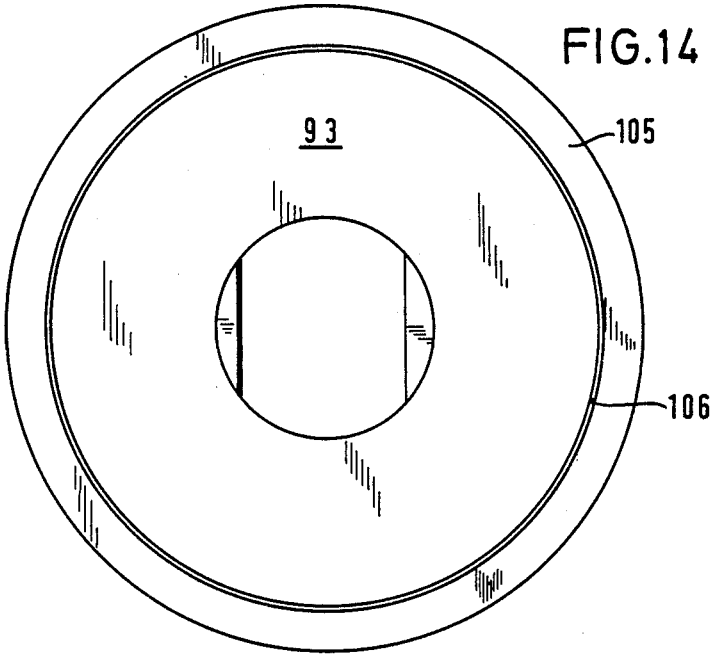
FIG. 14 is a view showing a further embodiment of the inventive device with a clamping flange and rollers as supporting elements.
Figure 16:
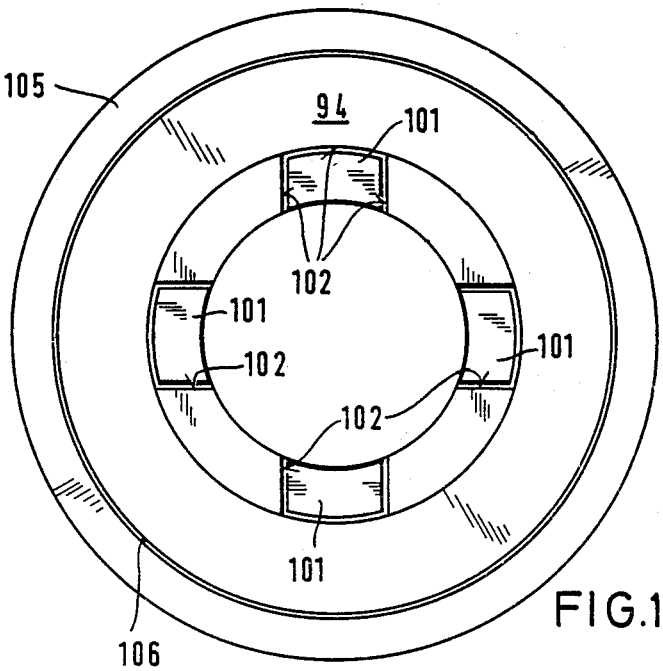
FIG. 16 is a side view of the device shown in FIG. 14.
Figure 18:
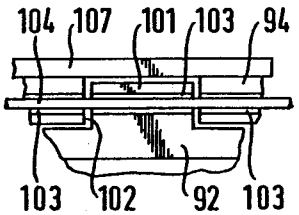
FIG. 18 is a view showing a section taken along the line XIII—XIII in FIG. 15.
Figure 15:
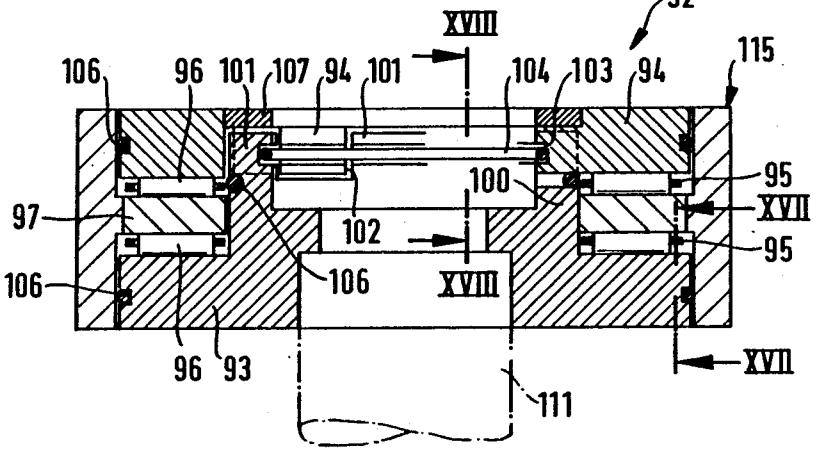
FIG. 15 is a side view showing of the device shown in FIG. 14 in section.
Figure 17:
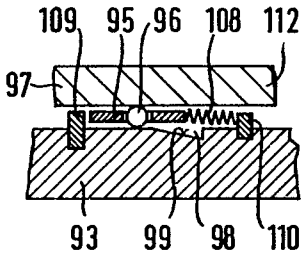
FIG. 17 is a view showing a section taken along the line XVII—XVII in FIG. 15.

The embodiment in accordance with FIG. 9 shows analogously to the multi-part clamping nut 37 on a working spindle 54, a multi-part clamping flange 55. A main body 56 is fixedly connected with the working spindle 54 and axially supported in addition by a spreading ring 57. The main body 56 is principally formed as the main body 38. It includes three radial openings 55 which accommodate outer balls 40 and inner balls 41. Also a recess 59 opens here the inner part of the radial opening 58, so that the inner balls can extend outwardly. In the recess 59, a hub 60 over a supporting flange 61 extends and acts together with clamping sleeve 62 upon a not-shown grinding disk similar to 15/29. The supporting flange 61 and the slamping sleeve 62 are fixedly connected with one another. Moreover, the clamping sleeve 52 carries a conical toothed wheel 63 for driving the grinding disk. Finally, the clamping disk 62 carries a ball bearing 64, by means of which it is supported in the housing of the hand-held power tool. The main body 56 has pockets 65 at its outer periphery. They extend from the radial openings 58 in releasing direction and dimension so that they can accommodate the outer balls 40. Springs 51 are also arranged in the pockets 65 and urge the outer balls 40 both always to their respective radial openings 58. A ring 66 surrounds both the main body 56 and the supporting flange 61 and is provided with a spherical trough 67. In addition, it has a conical toothed rim 68. It is to be understood that instead of the conical toothed rim, also one or more grooves can be provided. The conical toothed rim 68 or the grooves are adjusted opposite to an end stop 69 supported in the power tool housing. The hub 60 of the supporting flange 61 has pockets 70 with inclined supporting surfaces 71 associated with the inner balls 41, similarly to the multi-part clamping nut 37.

A further embodiment of the inventive device with the use of balls as rolling bodies is shown in FIGS. 10–13. A supporting flange 73 is mounted on a working spindle 72 which is shown in broken lines. The supporting flange also has three pockets 74 with inclined supporting surfaces 75, which are offset relative to one another by 120° and are similar to the previous embodiments. The supporting flange 73 carries on a hub 76 a clamping flange 77 which is held there by means of a securing ring 78 with an axial play. The clamping flange 77 has radial openings 79 opposite to the pockets 74 and the supporting flange 73. They accommodate the above described balls 40 and 41. The radial openings 79 are open inwardly to the pockets 74, and outwardly laterally to opposite end surfaces of the clamping flange 77. Thereby the inner balls 41 can move outwardly to the pockets 74 and the outer balls 40 can move outwardly into opposite direction. A profile ring 80 surrounds the clamping flange 77. It overlaps the end side of the clamping flange 77 at which the radial openings 79 are open for the outer balls 40, and serves as an abutment for the balls 40. Screws 81 are screwed in threaded openings 82 in the end flange of the ring 80. They extend through throughgoing openings 83 and depressions 84 in the clamping flange 77. Helical screws 85 are arranged in the depressions 84 under the heads of the screws 81. The helical springs 85 urge to press the ring 80 in an axial direction always against the clamping flange 77. Two diagonally extending grooves 86 are formed in the end surface of the clamping flange 77, in which also the depressions 84 are provided. A fork 87 which is shown in broken lines can engage with its ends into the grooves 86 and can abut also on an end edge 88 of the ring 80. The inner surface of the ring 80 is stepped as identified by reference 89. The thus produced inner cylindrical surface has axially extending trough 90. In clamping position of the device it accommodates the outer balls 40. The thus formed outer cylindrical surface 91 provides in releasing position of the ring 80 a play for the outer balls 40 for removing the clamping pressure which is applied by the inner balls 41.

In this embodiment of the inventive device, the clamping of a grinding disk is performed by hand after screwing of a clamping nut on the working spindle 72 and tensioning the clamping nut, by the working loading of the grinding disk at the beginning of the first grinding process.

For exchanging the grinding disk, an operator presses the fork 87 at the edge 88 and the adjacent end surface of the clamping flange 77. Then the operator rotates the grinding disk until the grooves 86 are located opposite to the ends of the fork 87. Now the ends of the fork can engage into the grooves 86. They displace the ring 80 in the axial direction against the action of the helical springs 85. The outer balls 40 roll first from their abutment surfaces at the supporting flange 73, and thereby the inner balls 41 can somewhat weaken the clamping pressure of the supporting surface 75. As long as the step 89 in the ring 80 moves on the outer balls 40, it provides so much of a deviating space that the clamping pressure by deflection of the inner balls 41 is completely lifted. The clamping nut can be easily released by hand.

In the embodiments of FIGS. 14–18, rollers are used as rolling bodies. In this version with a multi-part clamping flange 92, a main body 93 and a flange 94 which is connected with the main body 93 in a rotation-free manner but with an axial play, are supported via two roller cages 95 with the rollers 96 and a disk 97 inserted between the roller cages 95 into one another. The end surfaces of the main body 93 which face toward the rollers 96 are provided with a plurality of pockets 98 with inclined surfaces 99 in correspondence with the number of the rollers 96. The main body 93 has projections 101 on a collar 100, which engage into respective recesses 102 in the flange 94. The cylindrical inner surface which is formed by the projection 101 and the flange part near the recesses 102 is provided with a groove 103 for accommodating a spring ring 104. The spring ring 104 is smaller than the groove 103 at least by the axial play of the flange 94 relative to the main body 93. It therefore assemblies these both parts in the axial direction, without affecting the action of the clamping flange 92.

A ring 105 is firmly connected with the disk 97 and surrounds both the main body 93 and the flange 94. Respective grooves in the body 93 and in the flange 94 accommodate sealing rings 106 which prevent of the roller cages 95 from dirtying. A cover disk 107 serves as observation opening for covering the projection 101 and the recesses 102. At least one spring 108 presses the roller cage 95 which can cooperate with the pocket 98, rotatably into a switching position to an abutment 109. This abutment 109 is firmly connected with the main body 93 which also serves as an abutment 110 for the spring 108. A working spindle 111 which carries the main body 93 is shown in broken lines. Clamping of a grinding disk 15/29 with the clamping flange 92 is performed similar to the above described embodiments, without additional tools. In clamping position all rollers 96 abut against the parts of the inwardly arranged supporting surfaces which are flat and normal to the axis rotation, as can be seen from FIGS. 15 and 17. When it is necessary to exchange the grinding disk, an operator rotates the ring 105 in releasing direction identified by the arrow 112, with immovable grinding disk. The rollers 96 arranged in the pockets 98 roll on the flat parts of the end surface of the main body 93 until they reach the inclined surfaces 99. During engagement of the rollers into the pockets 98, the clamping pressure for the grinding disk is removed. The clamping nut can be released by hand and unscrewed.

A clamping nut 113 in the embodiment shown in FIGS. 19 and 20 is formed on the same principle as the above described multi-part clamping flange 92. A main body 114 has a nut thread 115. The hub of the main body 114 is flattened at its end at both sides and has mutually parallet opposite surfaces 116. At this end a clamping flange 113 is arranged with a respective central recess with mutually parallel surfaces 118. Thereby a rotary form-locking is obtained between the main body 114 and the clamping flange 117. A clamping ring 119 pressed on the hub of the main body 114 holds the main body 114 and the clamping flange 113 together so that an axial play between both parts sufficient for the clamping process is maintained. Two roller cages 95 with rollers 96 and a disk 97 are arranged between the flange 120 of the main body 114 and the clamping flange 117. The pockets 98 with inclined surfaces 99, the spring 108, the abutment 109 and the abutment 110 are identical to those in the clamping flange 92. The pockets and like can be provided both in the main body 114 and in the clamping flange 117. Advantageously, the main body 114 is provided with pin openings 121 which make possible releasing with a tool, in the event if rust or other damages make the release difficult. The disk 97 is here fixedly connected with a ring 122. The ring 122 overlaps only the flange 120, the disk 97 and the roller cage 95 with the rollers 96. The functions of the clamping nut 113 correspond to the functions of the clamping flange 92. It has also the advantage that it can be used for equipping of already available machine tools.

It will be understood that each of the elements described above, or two or more together, may also find a useful application in other types of constructions differing from the types described above. While the invention has been illustrated and described as embodied in a device for releasable mounting of diskshaped tools, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this inventin.

What is claimed as new and desired to be protected by Letters Patent is set forth in the appended claims:

1. A device for releasable mounting of a disk-shaped tool on a working spindle, comprising two flange members arranged to abut against the tool; supporting means arranged to support one of said flange members against its axial displacement on the working spindle, said supporting means being releasable so as to unload said one flange member from a clamping pressure, said one flange being provided with an inclined surface; an intermediate member axially non-displaceably connected with the working spindle and having a deviating space formed as a transverse opening said supporting means being formed as rolling bodies and arranged between said intermediate member and said one flange member so as to be abutting against said inclined surface of said one flange member and displaceable transversely to their supporting direction into said deviating space in said intermediate member.

2. A device as defined in claim 1; and further comprising at least one spring which urges said rolling bodies to its supporting position.

3. A device as defined in claim 1, wherein said deviating space is formed as a transverse opening in said intermediate member.

4. A device as defined in claim 1, wherein said rolling members are formed as balls including first balls which abut against said inclined surface and at least one second ball which supports said first balls in their abutment against said inclined surface of said one flange member.

5. A device as defined in claim 4, wherein said one flange member has a pocket, said inclined surface being formed in said pocket of said one flange member.

6. A device as defined in claim 5, wherein said one flange member has several said pockets with such inclined surface, the working spindle having respectively several transverse openings which form said deviating space and accommodates said balls.

7. A device as defined in claim 5, wherein said one flange member has a plurality of said pockets with such inclined surface, said intermediate member having a plurality of transverse openings forming said deviating space and accommodating said balls.

8. A device as defined in claim 4; and further comprising a multi-part clamping nut, said one flange member being formed as a clamping flange and forming a part of said clamping nut, said clamping nut including a main body with a nut thread, a hub part provided on said main body and carrying said clamping flange, a ring holding together said main body and said clamping flange, a further ring which surrounds said main body and said clamping flange and having a cylindrical surface with a spherical trough, and at least three pairs of said balls,

9. A device as defined in claim 8, wherein said deviating space includes three radial openings formed in said main body and offset from one another by 120° for radial guidance of said three pairs of said balls, and three pockets extending in a peripheral direction of said main body in releasing direction of said clamping nut for receiving outer balls of said pair of balls, said hub part having a recess, and said clamping flange having a hub engageable into said recess and provided with pockets with inclined surfaces for receiving inner balls of said pair of balls,

10. A device as defined in claim 9; and further comprising springs arranged in said pockets of said main body and urging said outer balls to their clamping position.

11. A device as defined in claim 1; and further comprising a multi-part clamping nut, said one flange member being formed as a clamping flange and forming a part of said clamping nut.

* * * * *